United States Patent [19]

Germer

[11] 3,958,822

[45] May 25, 1976

[54] LOCK FOR TRAILER DOOR

[75] Inventor: John A. Germer, Doylestown, Pa.

[73] Assignee: The Budd Company, Troy, Mich.

[22] Filed: Aug. 23, 1974

[21] Appl. No.: 499,963

[52] U.S. Cl. ..... 292/113; 292/110; 292/DIG. 36

[51] Int. Cl.[2] ..... E05C 5/00

[58] Field of Search ..... 292/113, 110, DIG. 36, 292/111

[56] References Cited

UNITED STATES PATENTS

| | | | |
|---|---|---|---|
| 1,368,276 | 2/1921 | Mathews | 292/113 |
| 1,573,866 | 2/1926 | Rogers | 292/113 |
| 1,871,580 | 8/1932 | Beadle | 292/113 |
| 2,449,275 | 9/1948 | Burns | 292/113 |
| 3,297,348 | 1/1967 | Griffiths et al | 292/113 |
| 3,476,424 | 11/1969 | Erickson | 292/113 |

FOREIGN PATENTS OR APPLICATIONS

| | | | |
|---|---|---|---|
| 320,244 | 10/1929 | United Kingdom | 292/113 |
| 846,071 | 7/1970 | Canada | 292/113 |
| 587,681 | 10/1933 | Germany | 292/113 |

*Primary Examiner*—Paul R. Gilliam
*Assistant Examiner*—Victor N. Sakran

[57] ABSTRACT

A lock assembly for latching an up and down movable door to a keeper secured to a sill of a trailer includes a main lever disposed on main shaft to operate a linkage mechanism to move a hook latch against the keeper.

1 Claim, 9 Drawing Figures

LOCK FOR TRAILER DOOR

Lever type locks for up and down moving doors in trailers, for example, are well-known and have taken a wide variety of different forms. Many such locks have involved arrangements in which the latch is pulled directly to the keeper and is slid over the keeper in a form of camming action. In such arrangements much effort is wasted in overcoming lateral forces which contribute nothing to closing the door.

Other latching mechanisms have included sliding actions between the latch and the keeper which require much work to be expended by the operator in overcoming the frictional forces. In many cases, the frictional forces increase as the door is tightened thereby requiring greater effort on the part of an operator to lock the door.

In still other arrangements, the mechanical advantages of trailer door locks are relatively constant during locking operations. Consequently, the effort required in moving the handle of the lock increases greatly as the door is being drawn closed.

Still other arrangements involve locks which remain closed because of high friction between the hook and keeper, gravity forces on the hook, and/or a spring behind the hook. Many of these means have proved unreliable in service.

It is an object of this invention to provide an improved door lock assembly for locking a door against a sill.

It is a further object of this invention to provide an improved door lock assembly in which friction between the locking elements is minimized during a locking operation.

It is still a further object of this invention to provide an improved door lock assembly with an improved toggle action which minimizes the tendency of the lock assembly to open after it has been locked.

In accordance with the present invention, an assembly for latching an up and down movable door to a keeper secured to a sill of a trailer is provided. The assembly includes a housing secured to the door with a main shaft being rotatably mounted to the housing. A latch includes a hooked or curved portion movable to engage the keeper during a locking operation and to be disengaged away from the keeper during an unlocking operation. A lever fixed to the main shaft is connected to the latch through a mechanical linkage. Movement of the lever from an unlocked to a locked position causes the hooked portion of the latch to move about an arcuate path until it is positioned below the keeper. A continued movement of the latch causes the hooked portion of the latch to move upwardly until the hooked portion engages and partially surrounds the keeper. A still further movement of the latch after engagement to a stop with the keeper toggles the linkage past a center position to maintain the assembly in a locked position.

Other objects and advantages of the present invention will be apparent and suggest themselves to those skilled in the art, from a reading of the following specification and claim, in conjunction with the accompanying drawings, in which:

Figure 2:
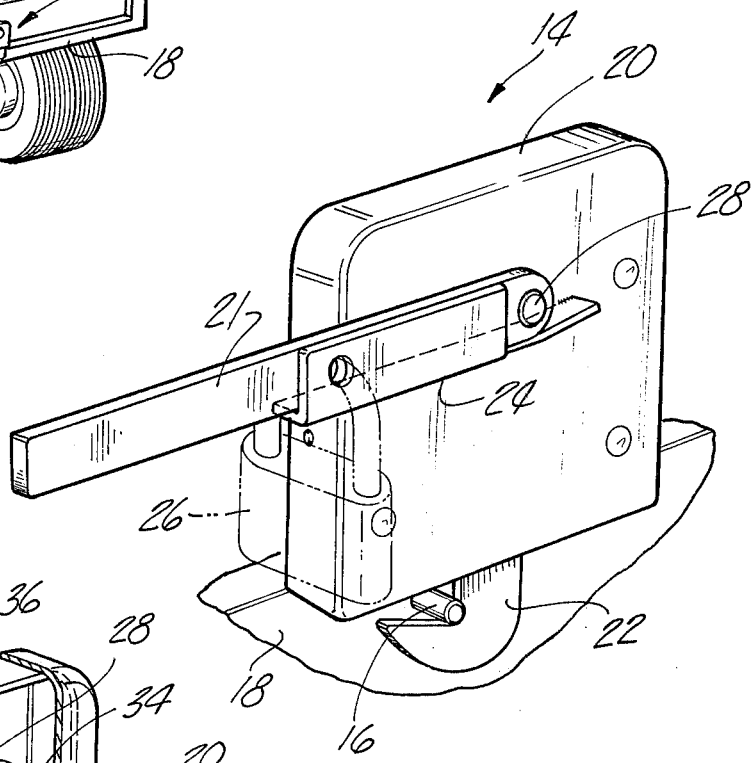
FIG. 2 illustrates an external view of a locking arrangement, in accordance with the present invention.
Figure 3:
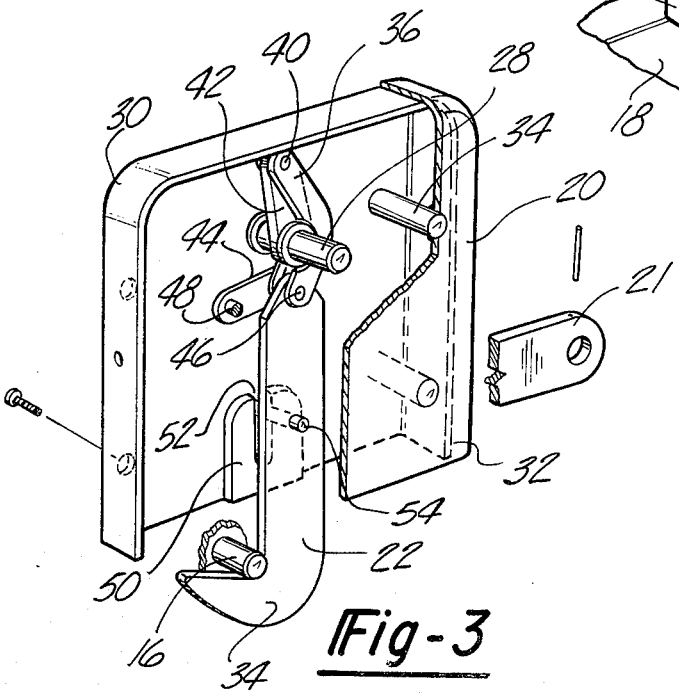
FIG. 3 is a partly exploded and partly broken away view of the locking arrangement illustrated in FIG. 1.
Figure 9:
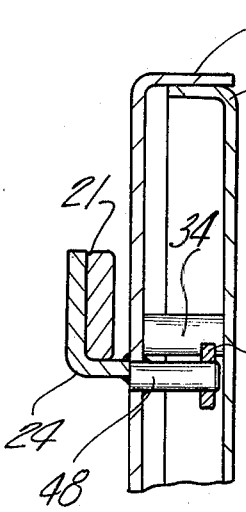
Figure 4:
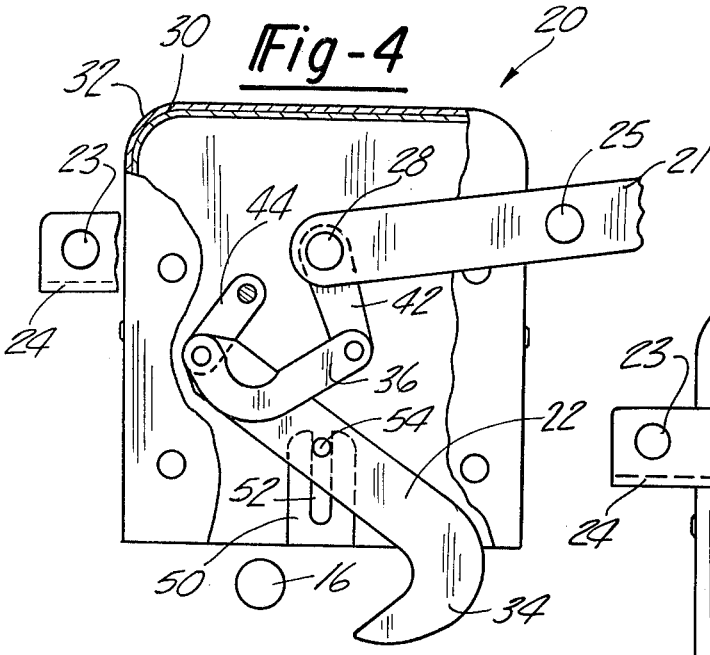
Figure 5:
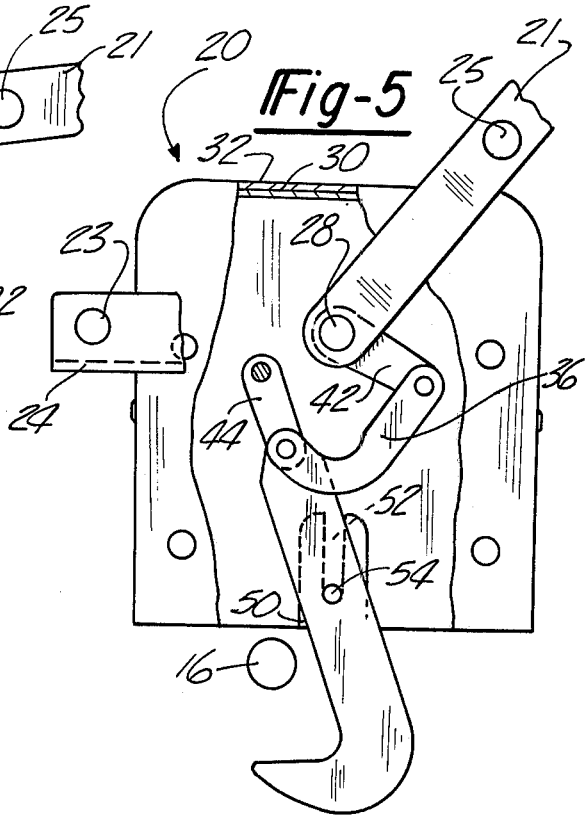
Figure 6:
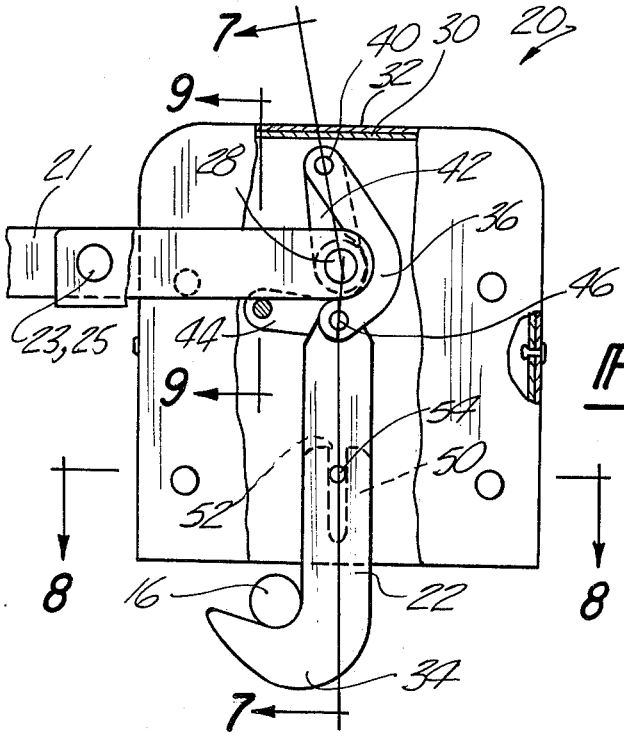
Figure 7:
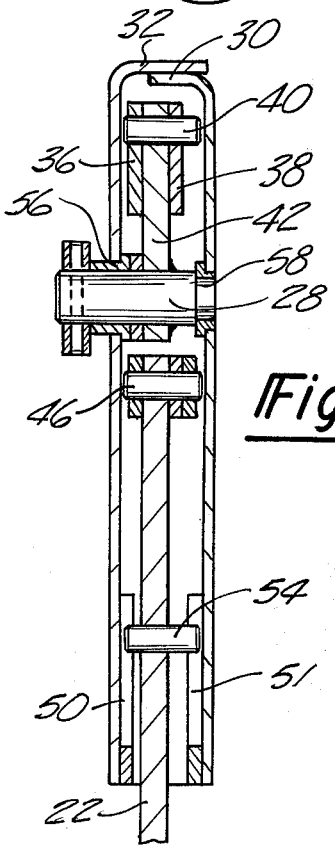
Figure 8:
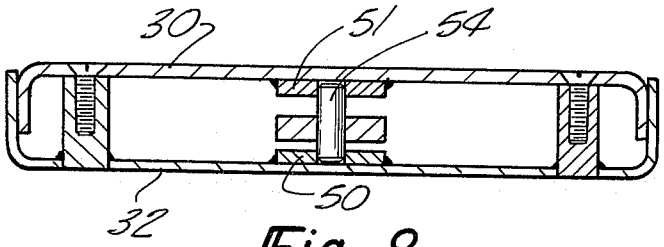

FIGS. 4, 5, and 6 are broken away views illustrating the operation of the locking arrangement illustrated in FIGS. 2 and 3 as the locking mechanism is shifted from an unlocked to a locked condition;

FIG. 7 is a cross-sectional view taken along lines 7—7 of FIG. 6;

FIG. 8 is a cross-sectional view taken along lines 8—8 of FIG. 6, and;

FIG. 9 is a cross-sectional view taken along lines 9—9 of FIG. 6.

Figure 1:
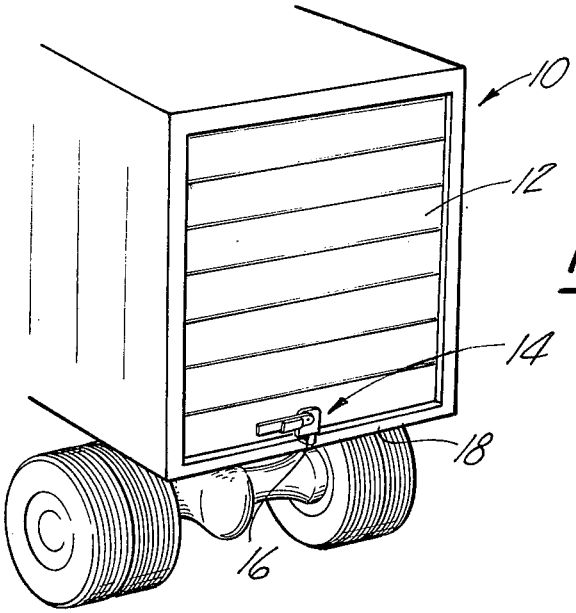
FIG. 1 illustrates a trailer having an up and down movable door having a lock thereon, in accordance with the present invention.

Referring particularly to FIG. 1, th trailer 10 includes an up and down movable door 12 of a conventional type. The door may be made in sections as illustrated. A latching assembly 14 is disposed toward the bottom of the door 12. A keeper 16 is secured to the sill 18 of the trailer. The latching assembly 14 is adapted to hold the door 12 securely down in a locked position or to permit the door 12 to be rolled up when it is in an unlocked position.

Referring particularly to FIG. 2, the latching assembly 14 is illustrated in a locked position. The assembly 14 includes a housing 20 suitably mounted to the bottom slat of the trailer door 12. A lever 21 is adapted to be moved about an angle of approximately 180° from a locked position which is illustrated in FIG. 2 to an unlocked position. As will be morefully described, when the lever 21 is moved during a locking or unlocking operation, a latch 22 is moved to engage or disengage the keeper 16 which is secured to the sill 18 of the trailer end. An angle hasp 24 is secured to the housing 20. Suitable aligned openings in the lever 21 and the angle hasp 24 are provided to receive a padlock 26 to lock the latching assembly in place. The lever 21 is secured to a shaft 28 and operates various linkages connected between the lever 21 and the latch 22 during operation, as will be described.

Referring particularly to FIG. 3, the housing 20 includes a bottom base member 30 and a cover plate 32. A plurality of studs 34 extend from the base member 30 to provide the means for mounting the cover plate 32 by any suitable means, such as welding or the like. The various parts illustrated in FIG. 3 illustrate the latching arrangement in a locked condition.

The latch 22 comprises a relatively elongated member having a curved or hooked portion 34 at one end which is adapted to engage or disengage the keeper 16. The other end of the latch 22 is disposed to receive a pair of similar links 36 and 38 held together by a pin 40. (See also FIG. 7). The pin 46, in addition to holding the links 36 and 38, also is connected to receive one end of a link 44. A link 42 is fixed to the shaft 28 and adapted to be rotated when the shaft 28 is rotated by the lever 21. Th ends of the links 36, 38 and 42 are connected by the aforementioned pin 40. As mentioned, the link 44 is secured to the free end of the latch 22 to the pin 46. The link 44 is also free to rotate about a pin 48 which is secured to the base member 30.

Plate guide 50 and 51 having elongated slots such as slot 52 (FIG. 3) are secuted to or form parts of the base member 30 or cover member 32. A pivot pin 54 is secured to the latch 22 intermediate its ends. This pivot pin 54 is adaped to be moved up and down in the slots 51 and 52 during a locking or unlocking operation, as will be described.

Referring particularly to FIGS. 4, 5 and 6, the operation of the latching assembly is illustrated as it is moved from an unlocked to a locked position. In FIG. 4, the lever 21 is disposed to the right of the housing 20 from an open position and is adapted to be moved in a counterclockwise direction to move the shaft 28. As more clearly illustrated in FIG. 7, the shaft 28 is held in place by any suitable means on cover plate 32 and adapted to ride on bearing 56. The end of the shaft 28 includes a suitable end portion to be rotatably mounted within a bearing 58 fixed to the base plate 30.

As the lever 21 is moved in a counterclockwise direction with the shaft 28, the link 42, which is also fixedly attached to the shaft 28, is also rotated in a counterclockwise direction. The link 42, being connected to the links 36 and 38, through the pin 46 cause the ends of the link 36 and 38 to be rotated in a counterclockwise direction. The other ends of the links 36 and 38, being connected to the end of the latch 22 through the pin 48, causes the latch 22 to be moved to the right and downwardly about a somewhat arcuate path. The pivot pin 54, being disposed in the slots 52 of the guide plates 50 and 51, directs this part of the movement of the latch 22. Thus the curved or hooked portion 34 of the latch 22 is caused to be moved about a somewhat arcuate path in a general clockwise direction. The link 44, connected between the end of the latch 22 and the base member 30, also controls the path of movement of the latch 22 as the lever 21 is moved. FIG. 5 illustrates a condition in which the latch assembly is partially locked. It is noted that in FIG. 5 that the hook or curved portion 34 is being moved under the keeper 16.

As the lever 21 continues to be rotated, the latch 22 continues to be moved until it contacts the keeper 16 with the curved portion 34 being disposed below the keeper 16. Due to the linkage between the lever 21 and the latch 22, continued movement of the lever 21 will cause the curved portion 34 to be moved upwardly almost linearly after the intermediate portion of the lever 21 has made contact with the keeper 16.

The upward movement of the curved portion 34 continues until it contacts the keeper 16. At this point, it is seen that the curved portion 34 will partly surround the keeper 16. A continued movement of the lever 21 to its final locking position will affectively toggle the latching apparatus so that the pin 40 is moved over center position with respect to the center of the longitudinal axis of the latch 22. The toggling action is important because the lever 21 is in a locking position, the latching apparatus is maintained locked. Any tampering with the latch 22 after the toggling, will not cause the lever or the various linkages to move. For example, if no toggling action were involved and the pin 40 were disposed to the right of the longitudinal axis of the latch 22, it would be possible to pull the portion 34 of the latch downwardly causing the linkages to be moved and causing the lever 21 to be moved in a clockwise direction to open the latching mechanism.

It is noted that as the lever 21 is moved from an open to a locked position that the operator is actually given a mechanical advantage so that the final stages of the latching operation is actually easier than the initial stages. This is contrary to many conventional designs in which friction and camming action increase as the final operation of locking is achieved.

What is claimed:

1. An assembly for latching a movable door to a keeper element secured to a sill comprising a housing secured to said door, a main shaft rotatably mounted to said housing about a center pivot, an elongated latch having two ends with a curved portion on one end movable to engage said keeper element during a locking operation and to be disengaged and away from said keeper element durin an unlocking operation, a plate guide secured to said housing having an elongated slot, a pivot pin secured intermediate the ends of said latch and disposed to ride in said slot to control the path of movement of said latch during locking and unlocking operations, a lever fixed to said main shaft, a pair of links of fixed lengths connecting the other end of said latch to said lever, a swingable link pivotally mounted between the other end of said latch and said housing, the movement of said lever from an unlocked to a locked positon causing said latch to move about an arcuate path until said curved portion is positioned below said keeper, means for directing continued movement of said latch vertically upwardly until said curved portion of said latch engages and partially surrounds said keeper, the direction of said continued movement of said latch being in the same plane as said center pivot, with a still further movement of said lever after engagement to a stop by said lever with said keeper toggling said pair of links past the center position of said center pivot whereby said assembly is maintained in a locked position, an angle hasp for limiting the movement of said lever during a locking operation, and said angle hasp and said lever including aligned openings to receive a padlock.

* * * * *